US007051563B2

(12) United States Patent
Eckerdt

(10) Patent No.: US 7,051,563 B2
(45) Date of Patent: May 30, 2006

(54) DOOR KEY RETENTION SECURITY SYSTEM

(75) Inventor: George H. Eckerdt, Victor, NY (US)

(73) Assignee: Key Systems, Inc., Victor, NY (US)

( * ) Notice: Subject to any disclaimer, the term of this patent is extended or adjusted under 35 U.S.C. 154(b) by 441 days.

(21) Appl. No.: 10/648,962

(22) Filed: Aug. 27, 2003

(65) Prior Publication Data

US 2004/0160130 A1 Aug. 19, 2004

Related U.S. Application Data

(60) Provisional application No. 60/441,131, filed on Jan. 21, 2003.

(51) Int. Cl.
*E05B 11/00* (2006.01)
*E05B 11/06* (2006.01)

(52) U.S. Cl. ..... 70/389; 70/390; 307/116

(58) Field of Classification Search ..... 70/389, 70/390, 429, 430; 307/116
See application file for complete search history.

(56) References Cited

U.S. PATENT DOCUMENTS

| | | | | |
|---|---|---|---|---|
| 3,906,762 | A * | 9/1975 | Austin et al. | 70/390 |
| 4,074,462 | A * | 2/1978 | McHeffey | 49/192 |
| 4,120,184 | A * | 10/1978 | Gerlach | 70/389 |
| 4,300,374 | A * | 11/1981 | Mullich et al. | 70/389 |
| 5,237,843 | A * | 8/1993 | Charbonneau et al. | 70/346 |
| 5,970,761 | A * | 10/1999 | Eden, Jr. | 70/390 |
| 2001/0039819 | A1 * | 11/2001 | McCurry | 70/389 |

FOREIGN PATENT DOCUMENTS

GB 2 388 154 A * 5/2003

* cited by examiner

*Primary Examiner*—Lynn Feild
*Assistant Examiner*—Michael Rutland-Wallis
(74) *Attorney, Agent, or Firm*—Brown & Michaels, PC

(57) ABSTRACT

This Door Key Retention Security System guarantees that a key used to enable operation of a powered door is retained or locked in the invention until the door is, once again, closed. Thus, it requires a person who has authorized access to the key to insert the key and properly turn it in order for a door to be opened. Then, while the door is open, the key is locked in the mechanism and cannot be removed. When the need for the door to be open is ended, the door can be closed and the key removed.

27 Claims, 11 Drawing Sheets

DOOR KEY RETENTION SECURITY SYSTEM

RELATED APPLICATION

Figure 1:
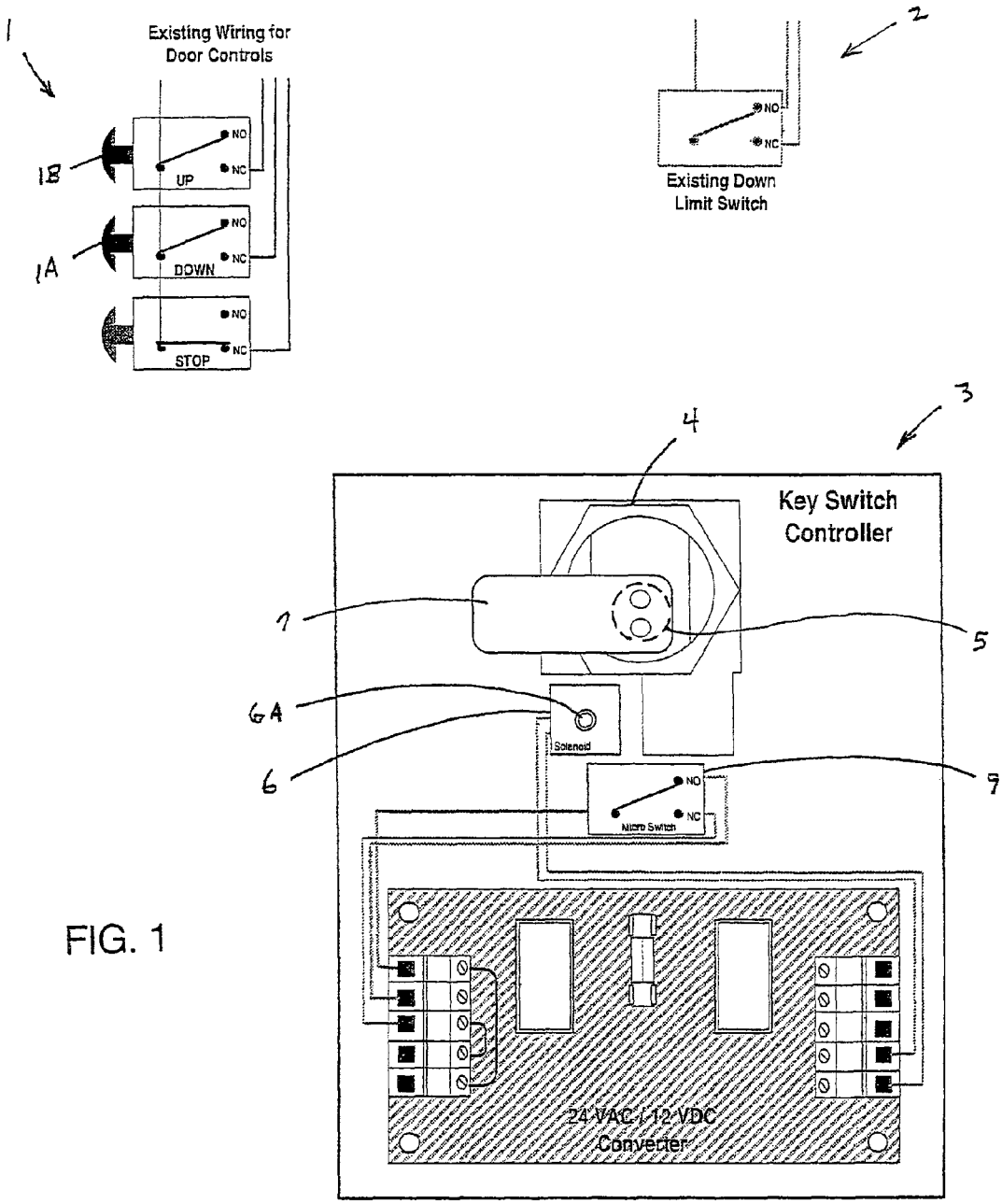

This application claims the benefit of U.S. Provisional Application No. 60/441,131, filed on Jan. 21, 2003, which provisional application is incorporated by reference herein.

FIELD OF THE INVENTION

This invention relates generally to the field of controlling the opening and closing of doors by designated personal with an assigned key. It deals primarily with powered doors used in commercial settings, but should not be seen as limited to this field.

BACKGROUND OF THE INVENTION

Many warehouses, home improvement centers, lumberyards, retail stores, and other commercial enterprises have doors that should not be left open and unsupervised at any time. (The same can also be said of many residential doors.) These doors are used to permit ingress and egress, allowing various items or products to be removed as well as accepting delivery of new or returned items or products. However, unsupervised ingress and egress via such doors creates major problems. For example, unsupervised open access can create a hazardous and dangerous situation with the possibility of injury to an invitee, a customer, an employee or even to a trespasser. This type of situation has the potential for creating legal liability for the owner even if the owner was not at fault. In addition, unsupervised ingress and egress often leads to the theft of goods or merchandise (either outgoing or incoming). This is, in fact, a rampant problem in commercial settings, particularly when a door is left open and unattended. Substantial energy loss and theft cause hardship to the company in terms of direct financial loss. However, it also causes loss to customers due to the increases in pricing made to cover such losses.

There is, therefore, a need for assigned management supervision to be present while the door is open. Where this cannot be guaranteed, there is a distinct tendency for managerial personnel to leave a door to the supposed supervision of employees while handling other ongoing business matters. In order to eliminate this problem, it is necessary to find some way of requiring the presence of appropriate managerial personnel any time a door is open in order to (a) control and supervise goods or merchandise leaving or arriving at the open door and (b) to control and supervise people leaving or entering the premises at the open door.

SUMMARY OF THE INVENTION

It is not unusual for doors to require a key for opening. This invention, however, guarantees that the key is retained or locked in the invention until the door is, once again, closed. Thus, it requires a manager or a specifically assigned person (or an owner for residential purposes) who has registered access to a key to insert the key and properly turn it in order for a door to be opened. Then, while the door is open, the key is locked in the mechanism and cannot be removed. When the need for the door to be open is ended, the door can be closed and the key removed. The key assignment can be computer designated to a particular person indicating the time of removal and the time of the return. Alternatively, the key can be permanently assigned to a particular person or in possession of the owner. One way or the other, the invention requires the key designee to remain at the door until the need for it to be open has passed and the door is closed. Otherwise, the key holder must leave the key in the lock and risk its loss to unauthorized personnel. This risk is unacceptable to both owners and managers, effectively forcing compliance.

BRIEF DESCRIPTION OF THE DRAWING FIGURES

FIG. 1 provides an initial schematic view showing basic elements of my invention and basic elements of a powered door's controls prior to installation of my invention.

Figure 2A:
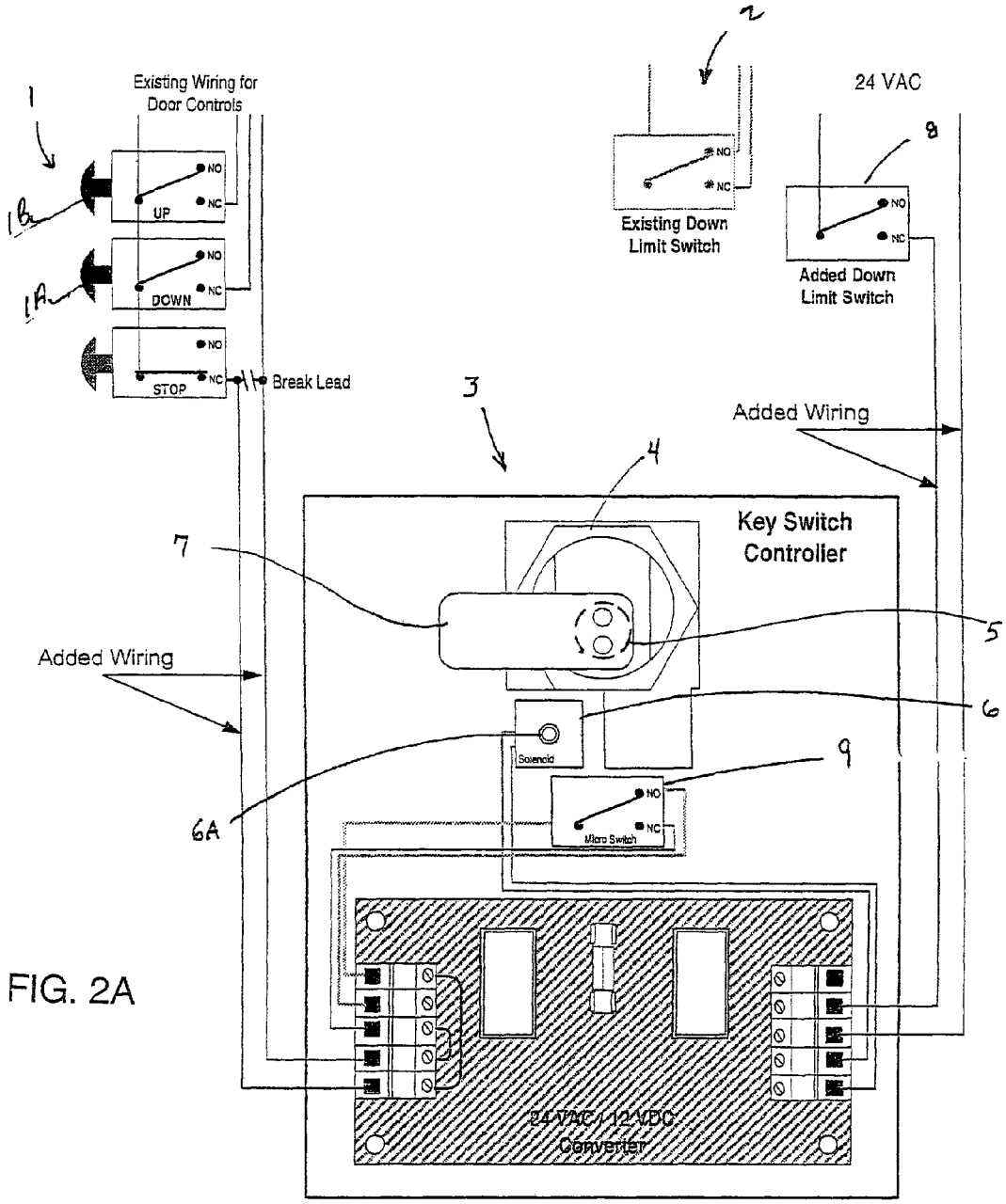

FIG. 2A provides a schematic view showing basic elements of my invention and basic elements of a powered door's controls following the installation of my invention. The door is closed and locked, with no power available for its operation. The key for the door can be withdrawn.

Figure 2B:
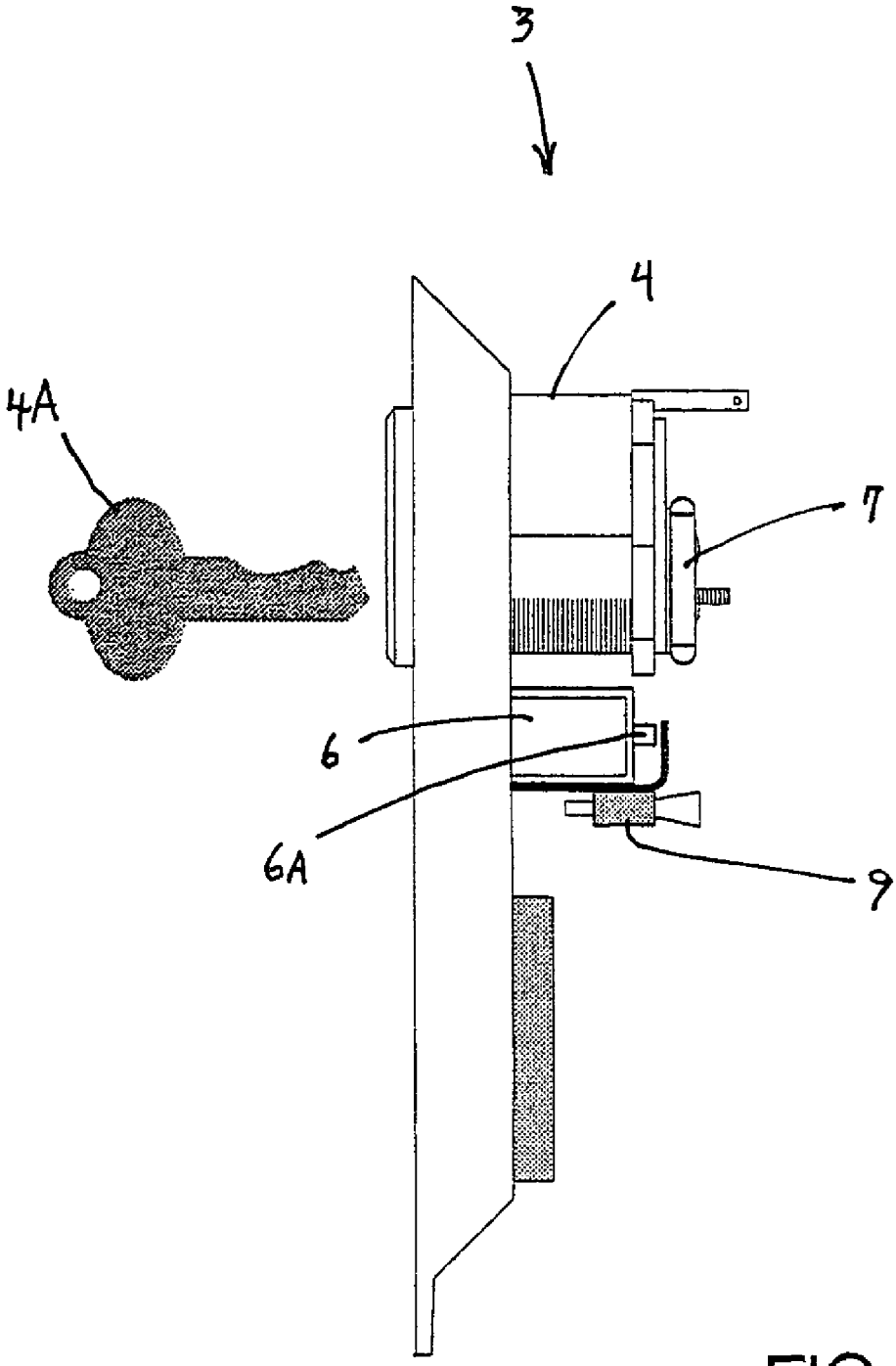

FIG. 2B provides a schematic view showing basic elements of my invention illustrated in FIG. 2A from the side.

Figure 3A:
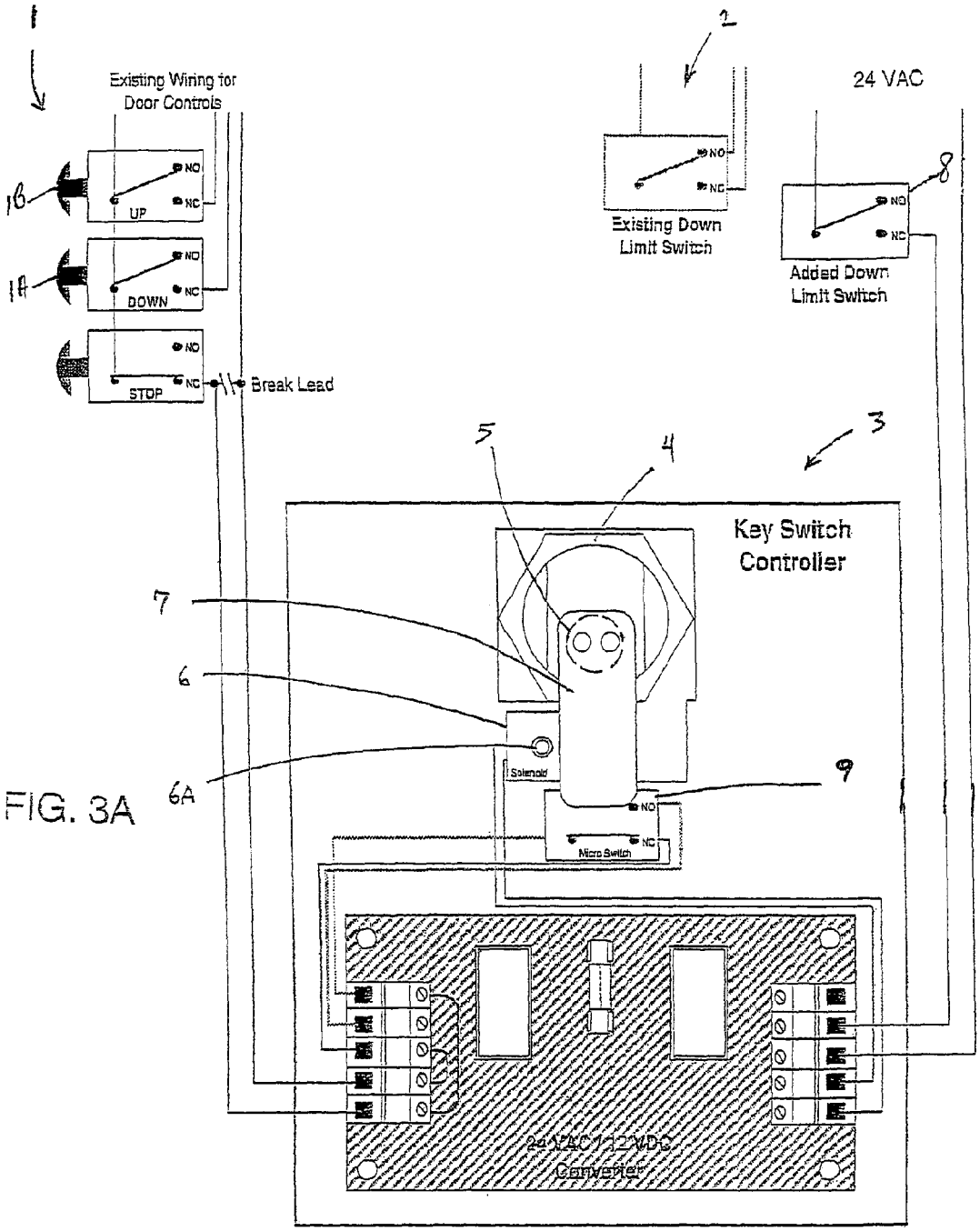

FIG. 3A provides a schematic view where the door is closed and unlocked, with power available for its operation. The key cannot be withdrawn while in the unlocked position, but can be turned back to the unlocked position and withdrawn.

Figure 3B:
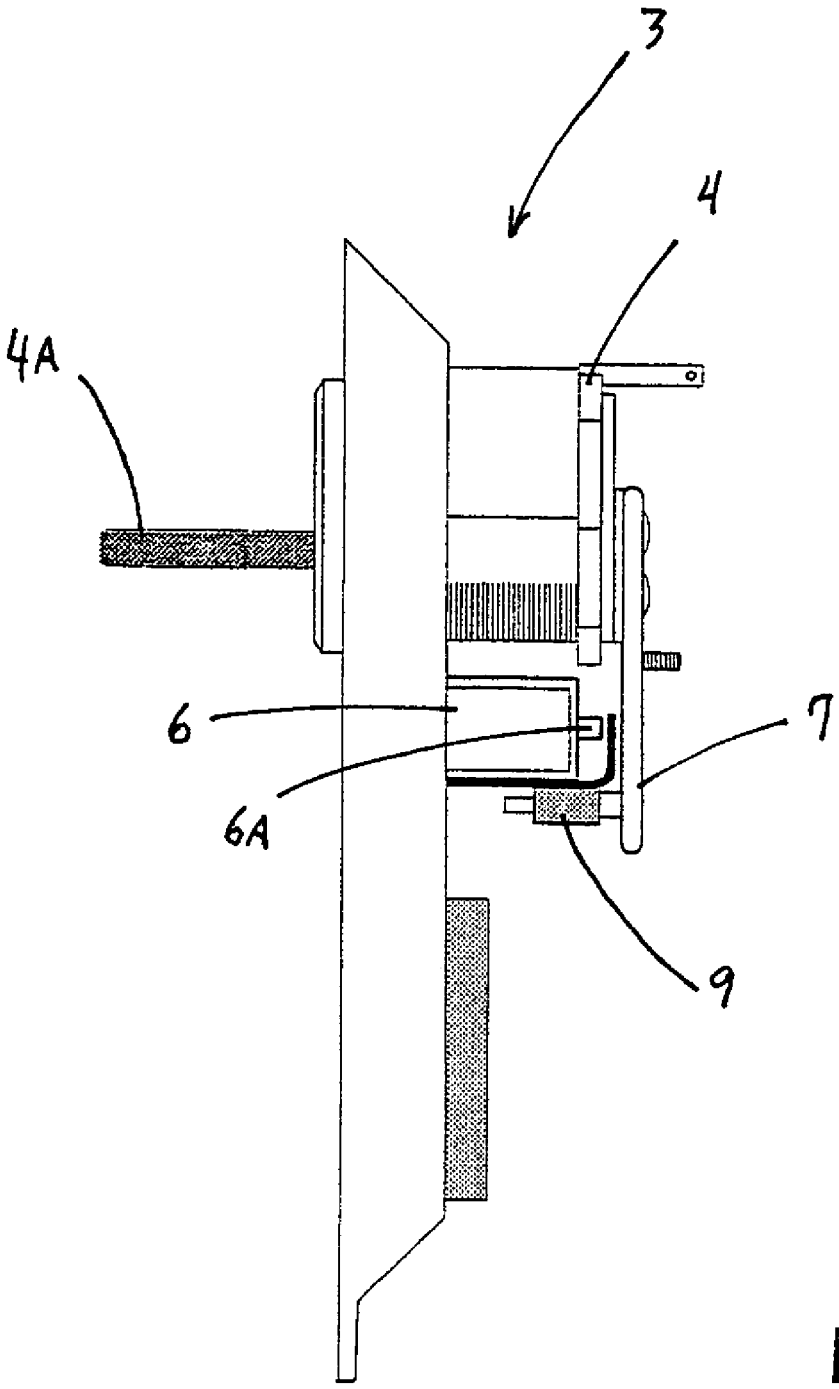

FIG. 3B provides a schematic view showing basic elements of my invention illustrated in FIG. 3A from the side.

Figure 4A:
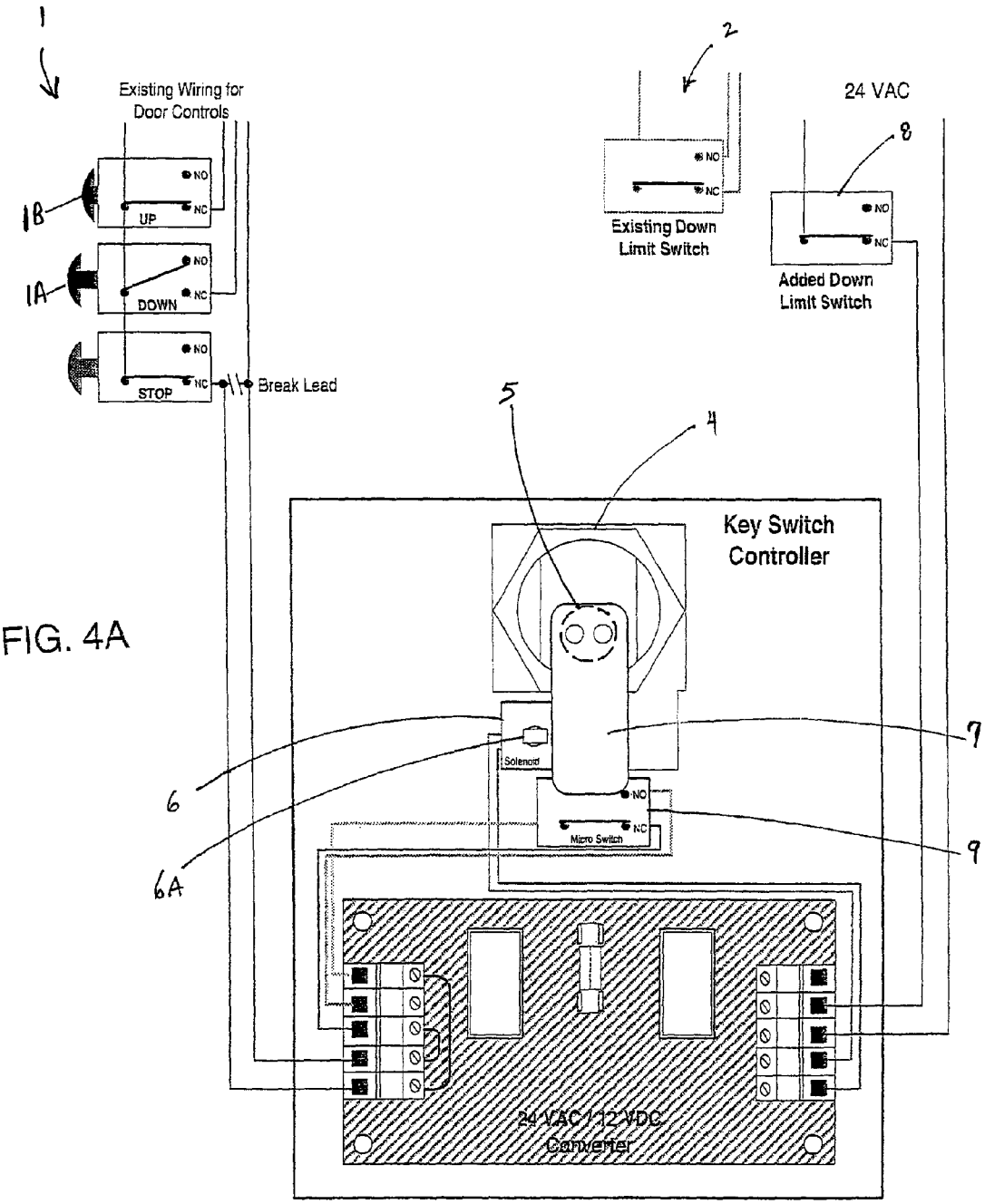

FIG. 4A provides a schematic drawing where the door is open and unlocked, with power available for its operation being used to open the door. The key cannot be turned back to the unlocked position and withdrawn.

Figure 4B:
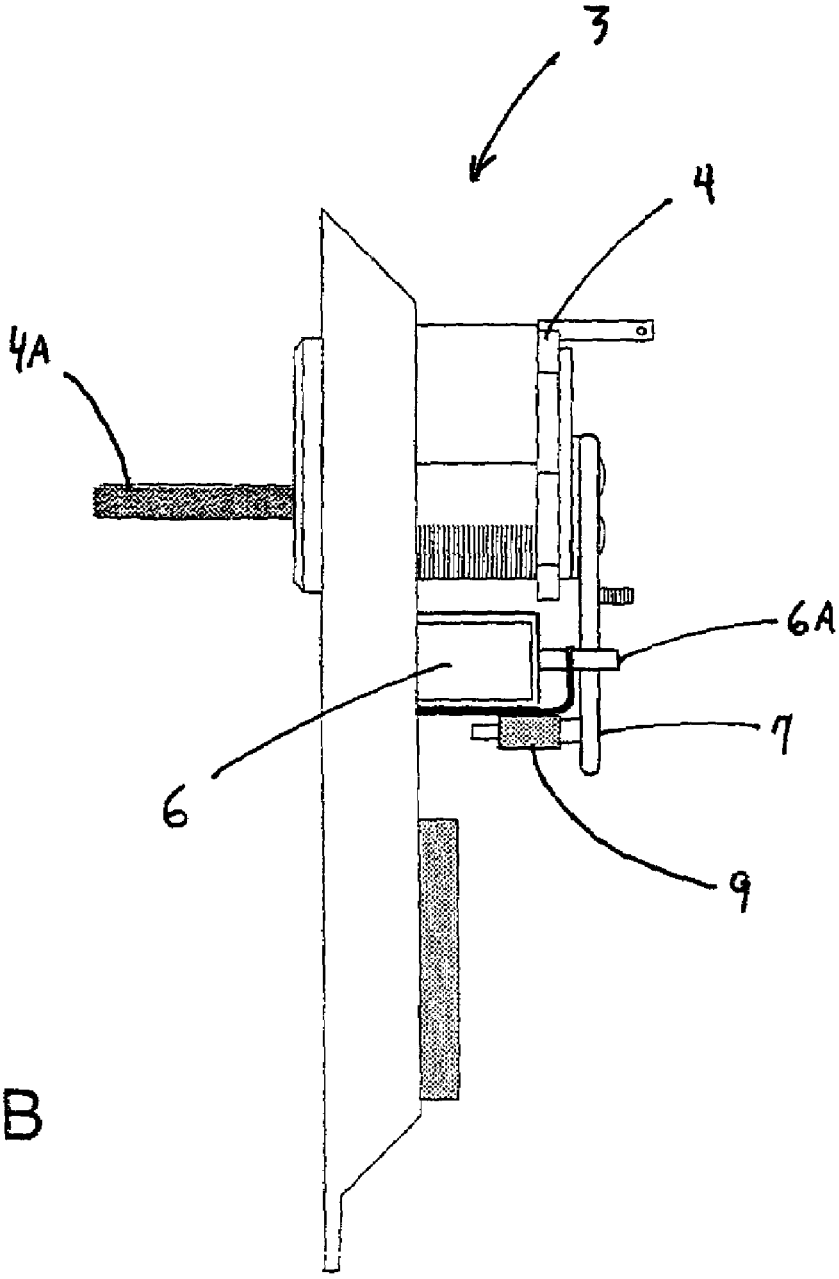

FIG. 4B provides a schematic view showing basic elements of my invention illustrated in FIG. 4A from the side.

Figure 5A:
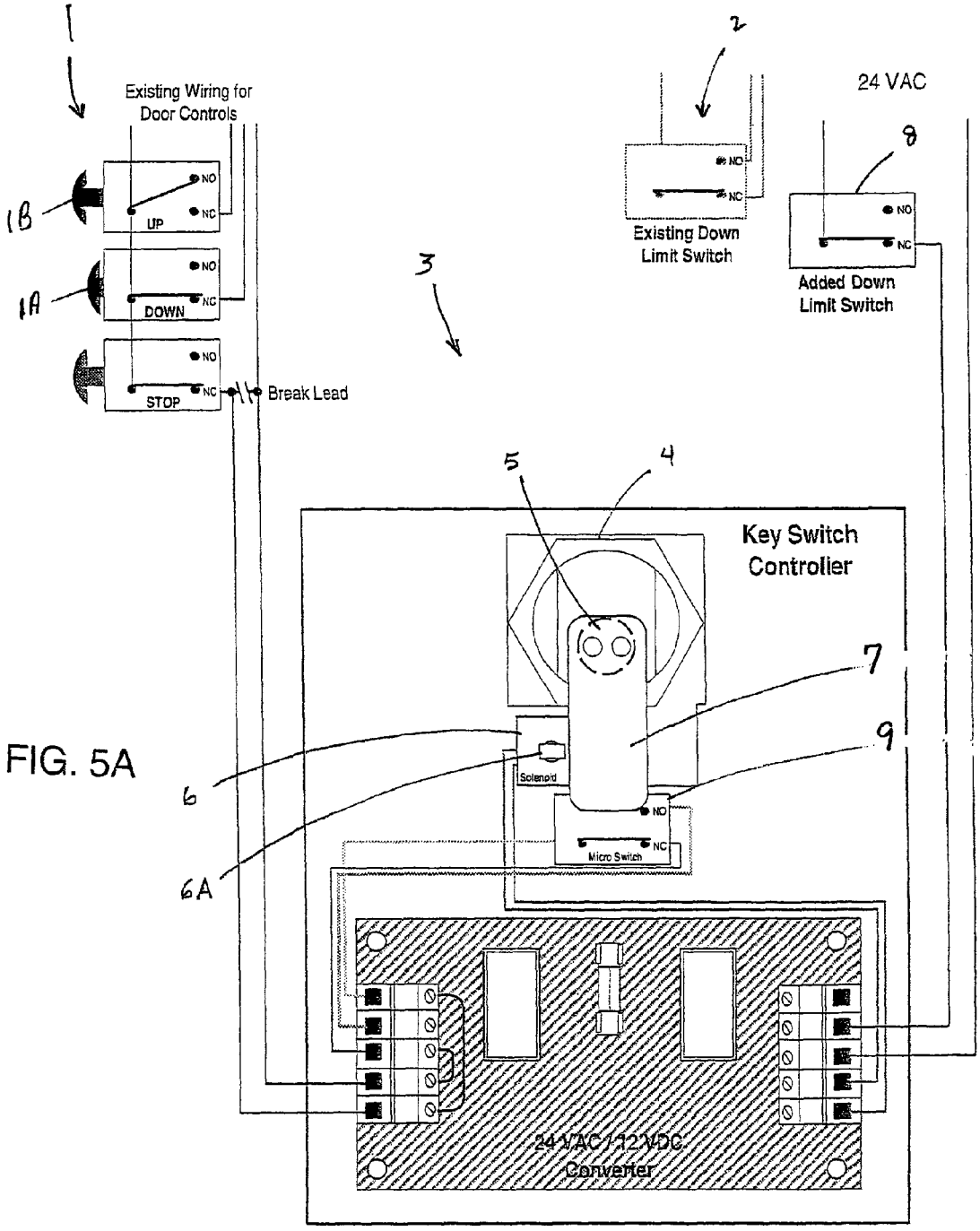

FIG. 5A provides a schematic drawing where the door is open and unlocked, with power available for its operation being used to close the door. The key cannot be turned back to the unlocked position and withdrawn.

Figure 5B:
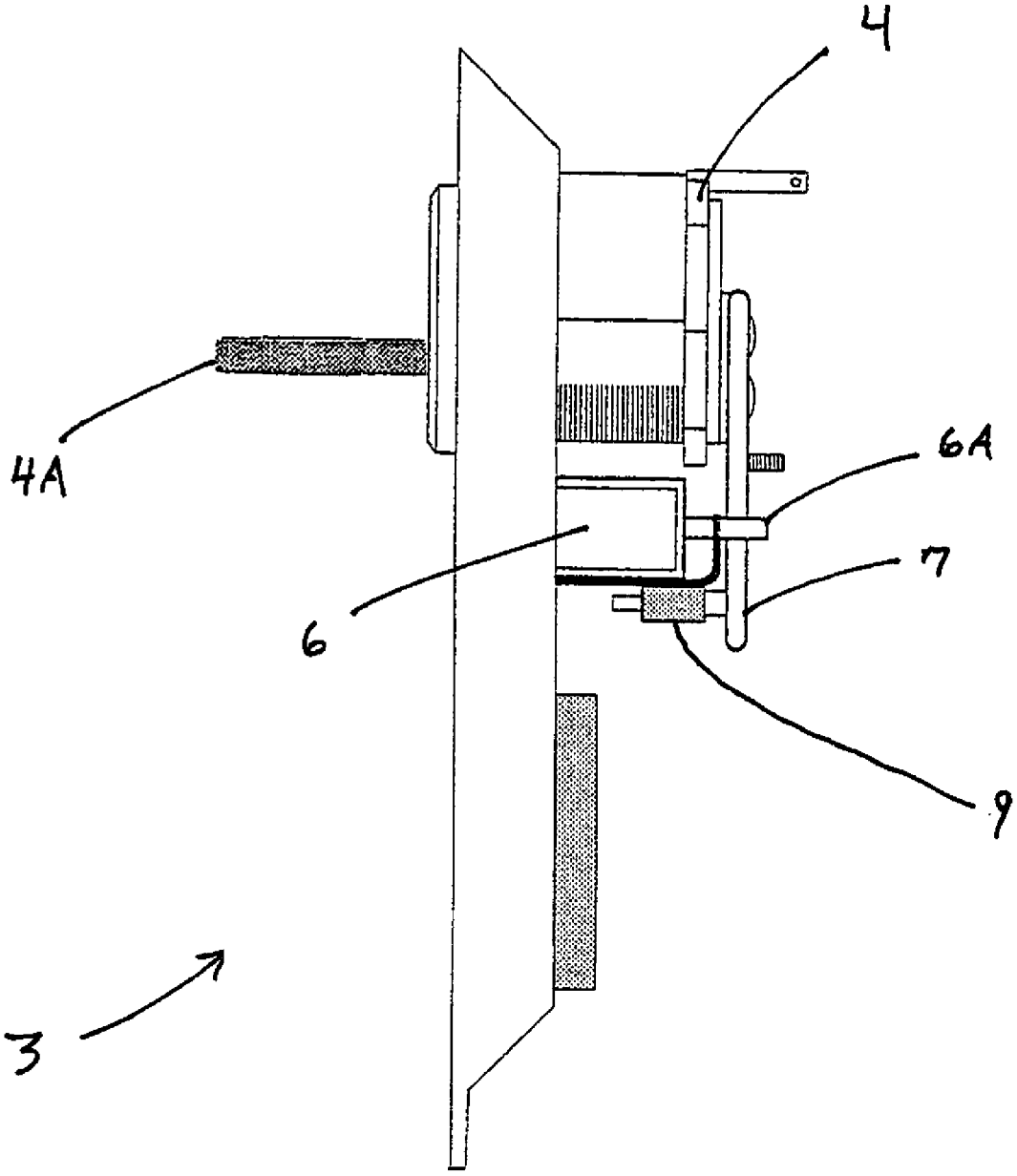

FIG. 5B provides a schematic view showing basic elements of my invention illustrated in FIG. 5A from the side.

Figure 6A:
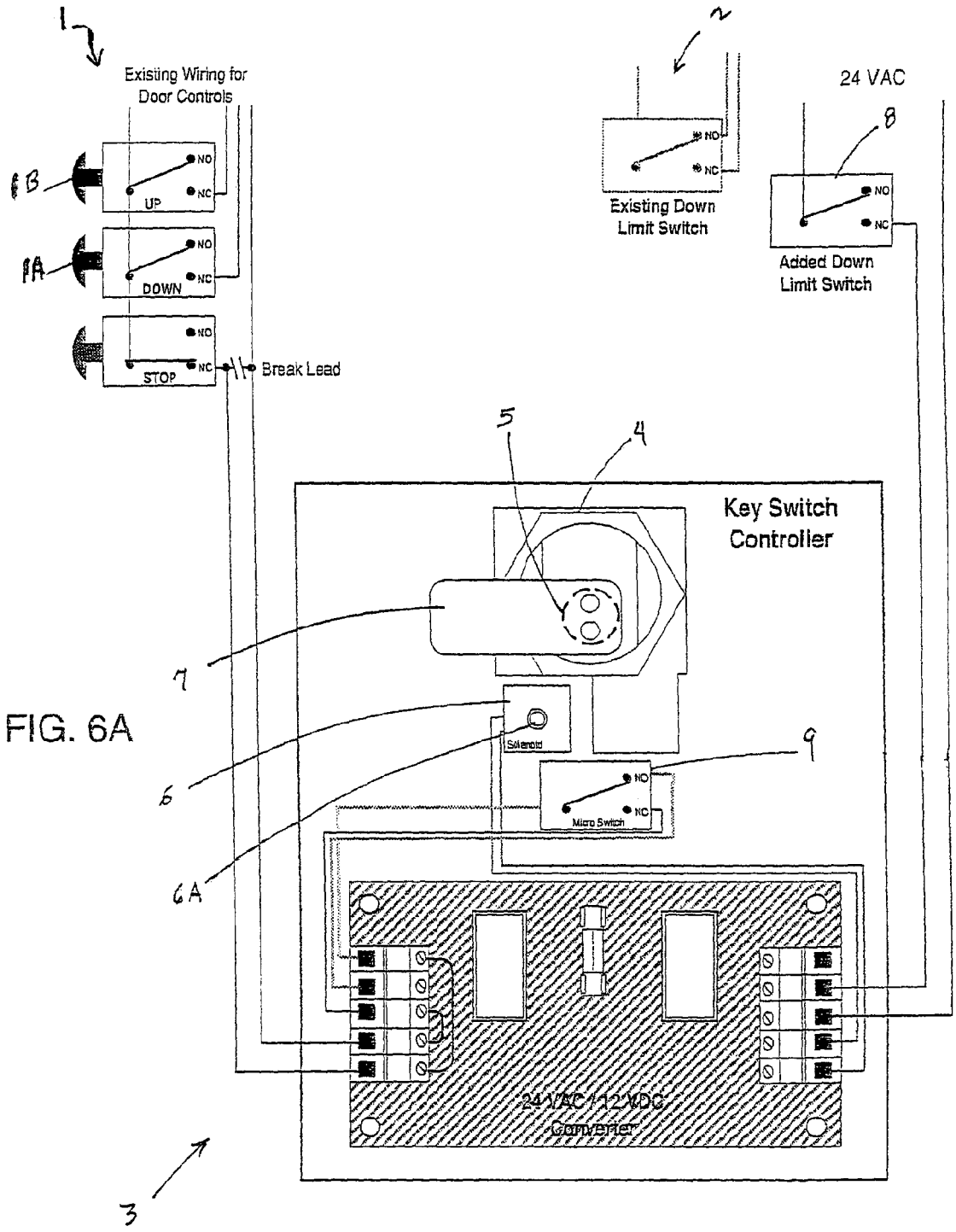

FIG. 6A provides a schematic drawing where the door is closed and locked, with power unavailable for its operation. The lock has been turned back to the unlocked position and the key can now be withdrawn.

Figure 6B:
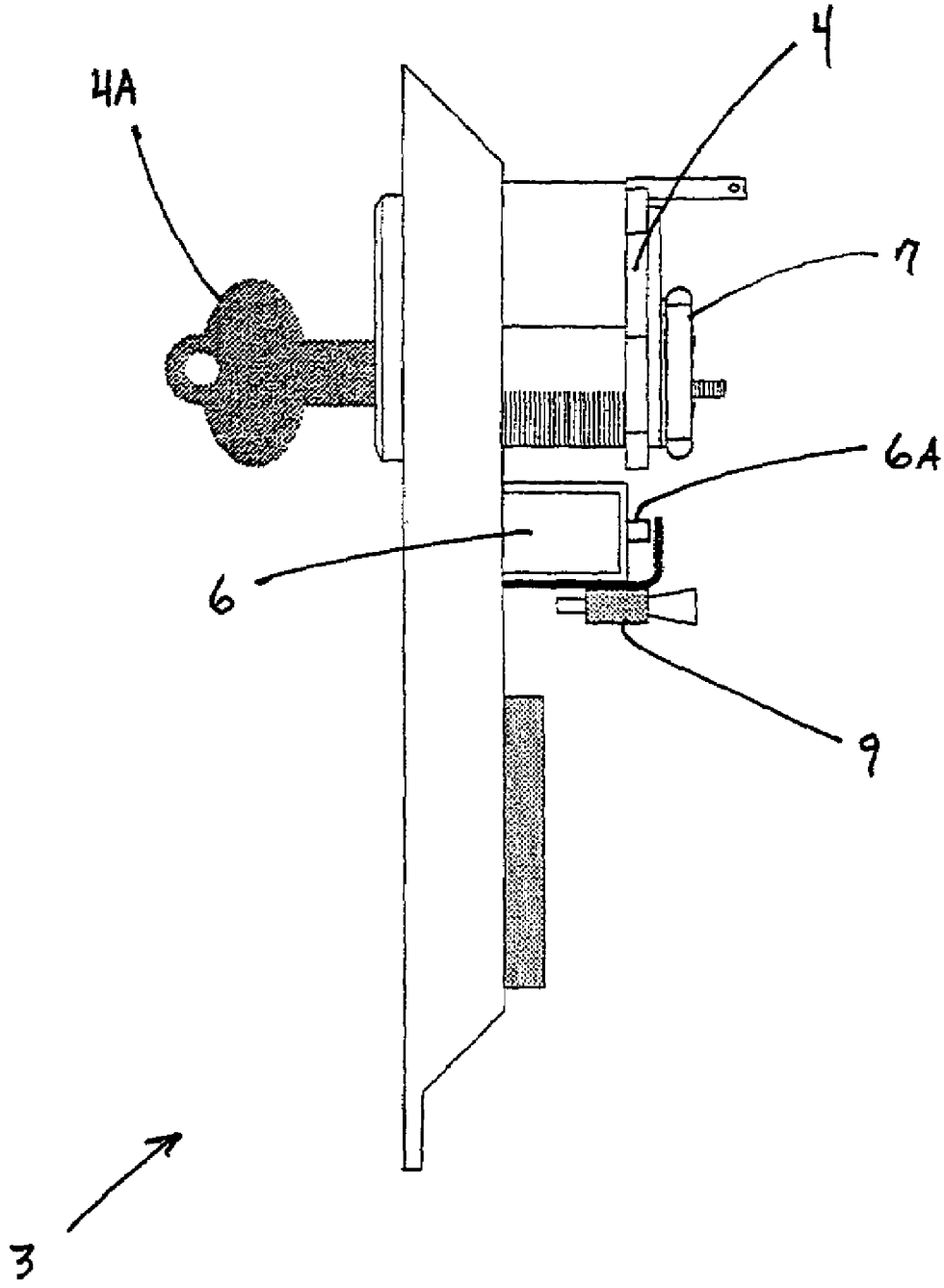

FIG. 6B provides a schematic view showing basic elements of my invention illustrated in FIG. 6A from the side.

DETAILED DESCRIPTION OF THE INVENTION

The door key retention device of my invention is most suited for use with a powered door. Controls 1 typical for a door of this type are illustrated in FIG. 1. As will be noted from review of this drawing figure, such doors are usually provided with and have an existing down limit switch 2 that opens the circuit providing power to a down motor (not shown) via down button 1A.

In the preferred embodiment illustrated, my invention introduces a key switch controller box 3 with a lock 4 having a turnable barrel 5. In the schematics provided, the rear of lock 4 is illustrated; however, the front of lock 4 has, as is typical, a slot for insertion of a key 4A. (A slot and key are common to most locks and are not specifically illustrated in the drawing figures.) As is usual with many barrel locks, Barrel 5 can be turned from a locked position where the key can be withdrawn from said slot to an unlocked position where the key cannot be withdrawn from said slot. (Barrel 5 is in a locked position in FIGS. 1, 2A, 2B, 6A and 6B, and in an unlocked position in FIGS. 3A, 3B, 4A, 4B, 5A and 5B.) However, unlike most locks, my invention provides apparatus preventing barrel 5 (and lock 4) from being returned to the locked position unless the door is closed.

This apparatus used to prevent lock 4 from being returned to the locked position includes an electrically actuated member, such as solenoid 6 having plunger 6A. When actuated, plunger 6A is extended as shown in FIGS. 4A through 5B. (This condition is indicated in FIGS. 4A and 5A by showing plunger 6A as a square.) When extended, plunger 6A blocks the rotation of an extension 7 attached to barrel 5 and rotating therewith. This, in turn, blocks the return of barrel 5 and lock 4 to a locked position. Power is supplied to solenoid 6 via added down limit switch 8 only when the door is open.

The sequence illustrated in FIGS. 2A through 6B illustrates my system in operation. FIGS. 2A and 2B provide a natural progression from FIG. 1, showing the means by which my controller box 3 is added to the wiring for a powered door. As will be noted, controller box 3 is added in the basic power circuit, for the door and is provided with a power circuit micro-switch 9 for opening and closing the circuit, thereby controlling the supply of power used to open and closed the door. This circuit is closed and power supplied to the door controls 1 when, using a key in lock 4, barrel 5 is rotated to the unlocked position. This rotates extension 7 to the position shown in FIGS. 3A and 3B, where it depresses micro-switch 9, providing power to door controls 1. At this point, power is available and up button 1B could be used to open the door. Alternatively, the key/door could be returned to an unlocked position and removed.

The last option mentioned is, however, lost as soon as the door is raised. A down limit switch 2 is typical in powered doors and serves to open the circuit supplying power to bring the door down when the door reaches a down position. In my invention, I use an added down limit switch 8 to control the supply of power to solenoid 6. Added down limit switch 8 closes, providing power to solenoid 6 whenever the door is not closed. It can be added in series to the circuit having existing down limit switch 2, but does not replace switch 2.

In FIGS. 3A and 3B, the door has power, but the up button 1B has not yet been pressed. As soon as it is operated and the door opens, added down limit switch 8 closes and provides power to solenoid 6, causing the extension of plunger 6A. (See, FIGS. 4A and 4B.) Plunger 6A now blocks the return of extension 7 to its previous position. It likewise prevents the return of the lock to an unlocked position and thereby prevents the removal of its key. Even when it is being returned to its closed position via the use of down button 1A, as illustrated in FIGS. 5A and 5B, added down limit switch 8 continues to supply power to solenoid 6, blocking removal of the key. It is only after the door has once again reached a fully closed position, opening added down limit switch 8, that the flow of power to solenoid 6 is halted and solenoid plunger 6A withdraws. When solenoid plunger 6A withdraws, it no longer obstructs extension 7, and the key and extension 7 can be rotated/returned to the unpowered locked position. (See, FIGS. 6A and 6B). At this point the key can be removed from lock 4.

Thus, as illustrated and described, my invention provides a simple yet ingenious method and apparatus for securing the operation of a powered door. However, it should also be remembered that numerous changes could be made in the construction of my invention without exceeding the scope of the inventive concept outlined herein. Its scope can, therefore, be better judged by review of the claims that follow.

I claim:

1. A door key retention device for a powered door, comprising:

a lock for the powered door, said lock having a locked position, an unlocked position, and a key for moving said lock from a locked position to an unlocked position when it is inserted in said lock, which key can be withdrawn from said lock when the lock is in the locked position, but cannot be withdrawn from said lock when the lock is in an unlocked position, the door being provided with power so that it can be opened and closed only when the lock is in the unlocked position; and apparatus preventing the lock from being returned to the locked position unless the door is closed.

2. A device as described in claim 1, wherein said apparatus includes an electrically actuated member.

3. A device as described in claim 2, wherein said member physically prevents the lock from being returned to the locked position.

4. A device as described in claim 1, further including an electrically actuated member and a down limit switch, which switch opens a circuit supplying power to the electrically actuated member when the door has reached a closed position.

5. A device as described in claim 4, wherein said circuit is part of a circuit supplying power used to close the door.

6. A device as described in claim 5, wherein said member physically prevents the lock from being returned to the locked position.

7. A door key retention device for a powered door, comprising:

a lock for the powered door having a turnable barrel, the barrel having a slot for insertion of a key and being turnable by said key from a locked position where the key can be withdrawn from said slot to an unlocked position where the key cannot be withdrawn from said slot, the door being provided with power so that it can be opened and closed only when the barrel is turned to the unlocked position; and apparatus preventing the barrel from being returned to the locked position unless the door is closed.

8. A device as described in claim 7, wherein said apparatus includes an electrically actuated member.

9. A device as described in claim 8, wherein said member physically prevents the return of the barrel to the locked position.

10. A device as described in claim 9, wherein said member interacts with an extension attached to said barrel.

11. A device as described in claim 10, wherein said member prevents the return of the barrel to the locked position by physically blocking rotation of the extension attached to said barrel.

12. A device as described in claim 7, further including an electrically actuated member and a down limit switch, which switch opens a circuit supplying power to the electrically actuated member when the door has reached a closed position.

13. A device as described in claim 12, wherein said circuit is part of a circuit supplying power used to close the door.

14. A device as described in claim 13, wherein said member physically prevents the return of the barrel to the locked position.

15. A device as described in claim 14, wherein said member interacts with an extension attached to said barrel.

16. A device as described in claim 15, wherein said member prevents the return of the barrel to the locked position by physically blocking rotation of the extension attached to said barrel.

17. A door key retention device for a powered door, comprising:

a lock for the powered door having a turnable barrel, the barrel having a slot for insertion of a key and being turnable by said key from a locked position where the key can be withdrawn from said slot to an unlocked position where the key cannot be withdrawn from said slot, the door being provided with power so that it can be opened and closed only when the barrel is turned to the unlocked position; and an electrically actuated solenoid plunger preventing the barrel from being returned to the locked position unless the door is closed.

18. A device as described in claim 17, wherein said plunger physically prevents the return of the barrel to the locked position.

19. A device as described in claim 18, wherein said plunger interacts with an extension attached to said barrel.

20. A device as described in claim 19, wherein said plunger prevents the return of the barrel to the locked position by physically blocking rotation of the extension attached to said barrel.

21. A device as described in claim 17, further including a down limit switch, which switch opens a circuit supplying power to the solenoid, causing extension of the solenoid plunger, when the door has reached a closed position.

22. A device as described in claim 21, wherein said circuit is part of a circuit supplying power used to close the door.

23. A device as described in claim 22, wherein said plunger physically prevents the return of the barrel to the locked position.

24. A device as described in claim 23, wherein said plunger interacts with an extension attached to said barrel.

25. A device as described in claim 24, wherein said plunger prevents the return of the barrel to the locked position by physically blocking rotation of the extension attached to said barrel.

26. A device as described in claim 10, wherein said extension is used to open and close at least one circuit providing power to operate the door.

27. A device as described in claim 19, wherein said extension is used to open and close at least one circuit providing power to operate the door.

* * * * *